United States Patent [19]

Smith

[11] 4,019,716

[45] Apr. 26, 1977

[54] FOLDABLE SELF-LEVELING TRIPOD SHAPED VEHICLE BUMPER JACK

[76] Inventor: Eugene C. Smith, 412 Maple St., Greensburg, Kans. 67054

[22] Filed: Sept. 2, 1975

[21] Appl. No.: 609,672

[52] U.S. Cl. ..... 254/139; 254/4 R

[51] Int. Cl.[2] ..... B66C 23/60

[58] Field of Search ..... 254/139, 139.1, 4 R, 254/4 B, 99, DIG. 1

[56] References Cited

UNITED STATES PATENTS

| | | | |
|---|---|---|---|
| 1,599,106 | 9/1926 | Weathers | 254/139.1 |
| 2,222,243 | 11/1940 | Sandstrom | 254/4 B X |
| 2,941,633 | 6/1960 | Hanks, Sr. et al. | 254/139 X |
| 3,013,772 | 12/1961 | Atherton et al. | 254/99 |
| 3,152,704 | 10/1964 | Russell | 214/86 A |
| 3,240,471 | 3/1966 | Townsend | 254/99 |
| 3,313,521 | 4/1967 | Sauka | 254/4 B |

*Primary Examiner*—Robert J. Spar
*Assistant Examiner*—Donald W. Underwood
*Attorney, Agent, or Firm*—John H. Widdowson; Edwin H. Crabtree

[57] ABSTRACT

A tripod shaped vehicle bumper jack for raising and lowering a vehicle. The jack legs are foldable for ease of storage. Attached to the end of each leg is a rotatable base plate so that the jack is self-leveling when it becomes necessary to lift a vehicle when the ground surface is at an angle to the horizontal. The vehicle is raised and lowered using a bumper hook attached to a cable driven by a worm gear driven windlass.

3 Claims, 5 Drawing Figures

FOLDABLE SELF-LEVELING TRIPOD SHAPED VEHICLE BUMPER JACK

BACKGROUND OF THE INVENTION

This invention relates generally to jacks used for lifting objects and more particularly but not by way of limitation, to an improved vehicle bumper jack.

Heretofore, there have been a number of different types of jacks used to lift materials and particularly vehicle bumper jacks used to lift the vehicle in order to change a tire or work on the under carriage of the vehicle. Many of the individual features disclosed in the subject invention have been used in prior art jacks. None of the prior art jacks use a combination of the following described elements to make up the novel foldable self-leveling tripod shaped bumper jack.

SUMMARY OF THE INVENTION

The subject invention makes the raising and lowering of a vehicle safer due to the strength of the tripod structure of the jack and the self-leveling feature of the tripod legs. The jack is easier to operate because of the worm gear driven windlass, as compared to a standard automobile ratchet type bumper jack. Also, the use of a cable with bumper hook is more flexible in the raising and lowering of vehicles that have bumpers at various heights from the ground level.

The invention includes a channeled vertical leg and two angled legs attached to a housing. Attached to the vertical leg is a hand operated worm gear windlass that winds the cable with bumper hook up and down. A cable lock attached to the cable guides the cable in the channeled vertical leg. The ends of the legs are attached to rotatable base plates.

Other objects and advantages of this invention will become evident from the following description when read in conjunction with the following drawings.

DETAILED DESCRIPTION OF THE DRAWINGS

Figure 1:
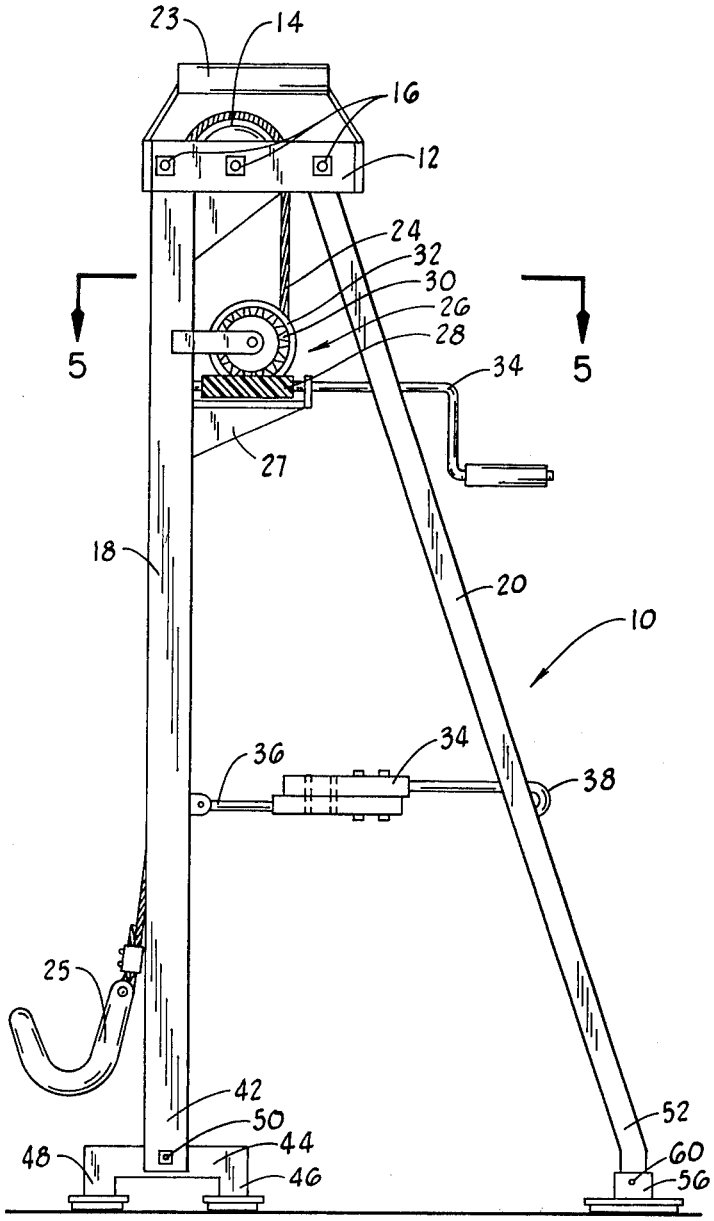
FIG. 1 is a side view of the vehicle bumper jack.

The tripod shaped vehicle bumper jack is characterized by general reference number 10. Jack 10 includes a housing 12 with a pulley 14 attached by a bolt 16 to the sides of the housing 12. Also, attached by a bolt 16 to the housing 12 are a channeled vertical leg 18, a first angled leg 20, and a second angled leg 22 (shown in FIG. 2). A handle 23 is attached to the top of the housing 12. The handle 23 is used for lifting the jack 10 and setting the jack 10 in the proper operating position for raising and lowering the vehicle.

Riding inside the channeled vertical leg 18 is a cable 24. The cable 24 has a bumper hook 25 at one end thereof for securing to the vehicle bumper. The other end of the cable 24 is connected to a worm gear driven windlass 26. The windlass 26 is attached to the back of the vertical leg 18 by plate 27. The windlass 26 includes a worm gear 28 driving a spur gear 30. The spur gear 30 is attached to a cable drum 32. The worm gear 28 is turned by a removable crank 34.

The first and second angled legs 20 and 22 are foldable by loosening the bolt 16 attached to the housing 12. This allows the operator to fold the angled legs 20 and 22 inward toward vertical leg 18 for compactness in storing the jack 10.

Figure 2:
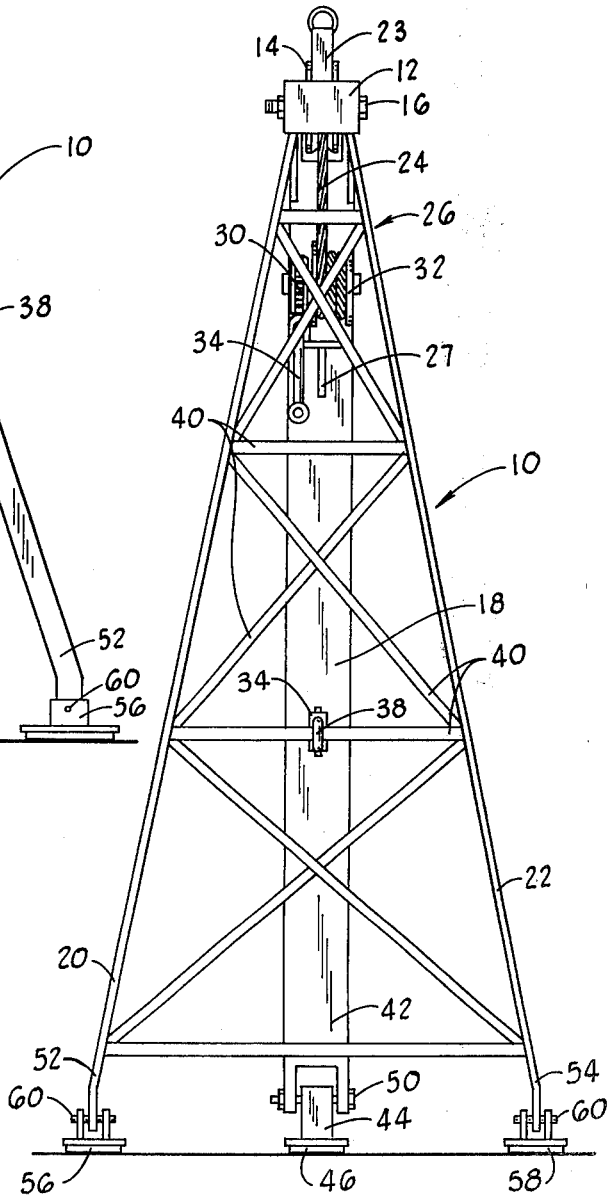
FIG. 2 is a rear view of the vehicle bumper jack.

When the jack 10 is in operation, the angled legs 20 and 22 are held in place by an adjustable hook 34 attached at one end 36 to the vertical leg 18 and the hook portion 38 secured to bracing 40 (shown in FIG. 2).

Attached to end portion 42 of vertical leg 18 is a rotatable base plate 44. The base plate 44 has legs 46 and 48 which are placed on the ground surface. The base plate 44 rotates about bolt 50 thereby allowing the leg 18 to be maintained in a vertical position when the jack 10 is placed on unlevel ground.

End portions 52 and 54 of the first and second angled legs 20 and 22 also includes rotatable base plates 56 and 58. The plates 56 and 58 are bolted to the legs by bolts 60.

FIG. 2 is a rear view of the jack 10. In this view the bracing 40 can be seen which rigidly holds together the angled legs 20 and 22. Also, in this view the cable 24 can be seen wound around the drum 32 of the worm gear driver windlass 26.

Figure 3:
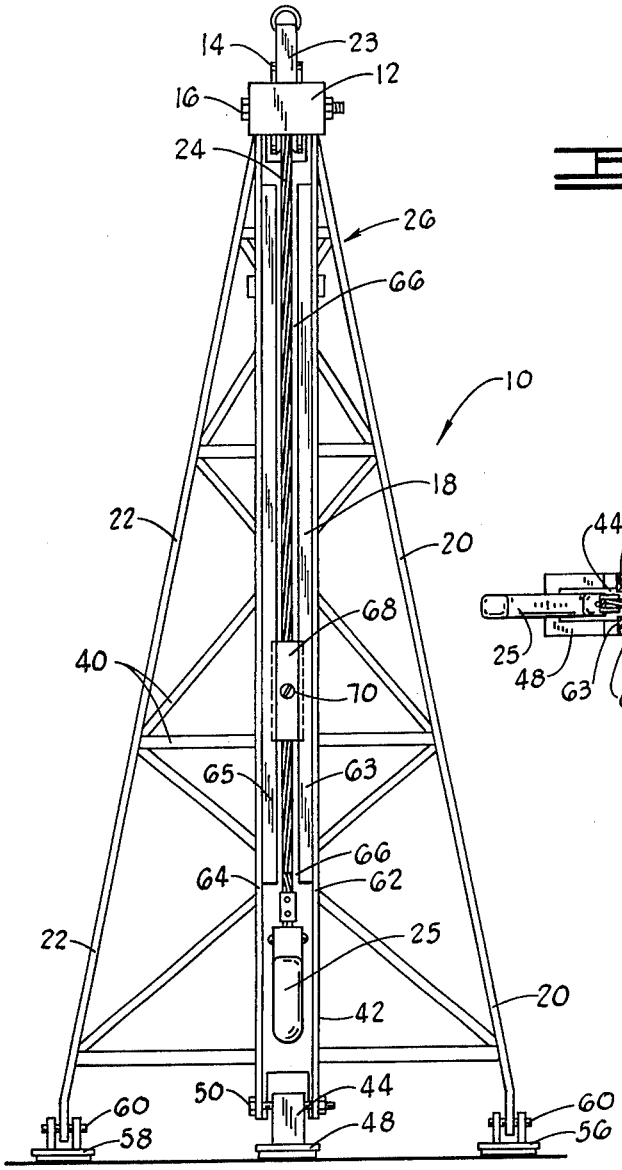
FIG. 3 is a front view of the vehicle bumper jack.

FIG. 3 is a front view of the jack 10. In this view the channeled vertical leg 18 can be seen with the cable 24 suspended between sides 62 and 64 of the leg 18. The front of the leg 18 is partially closed by flange portions 63 and 65 which are an integral part of sides 62 and 64. Between the flange portions 63 and 65 is formed a slot 66. The slot 66 has a width greater than the width of cable 24 but less than the width of a cable lock 68. The cable lock 68 is secured to the cable 24 by setscrew 70. The cable 24 above the lock 68 in the channeled vertical leg 18. The cable 24 below the lock 68 extends outwardly from the slot 66 so that bumper hook 25 can be secured to the vehicle's bumper.

Figure 4:
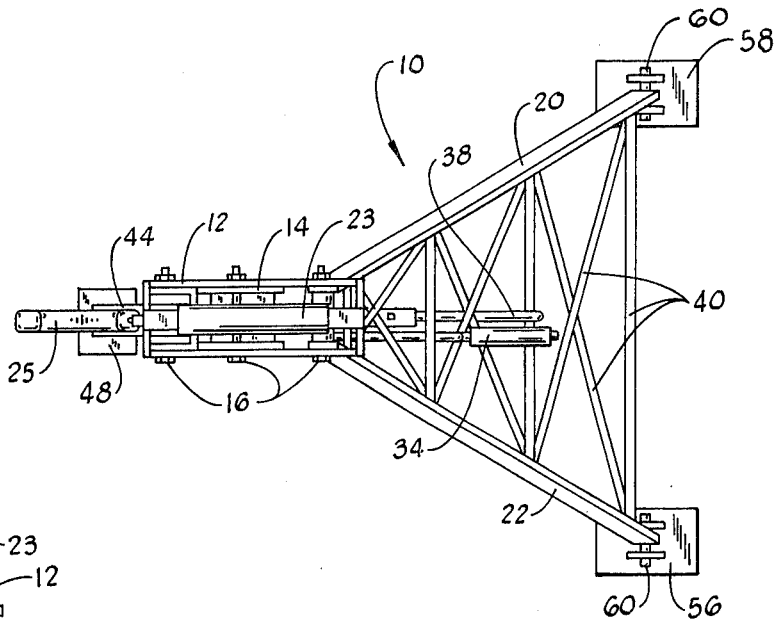
FIG. 4 is a top view of the vehicle bumper jack.

FIG. 4 is a top view of the jack 10. In this view the rectangular shaped rotatable base plates 44, 56 and 58 can be seen clearly.

Figure 5:
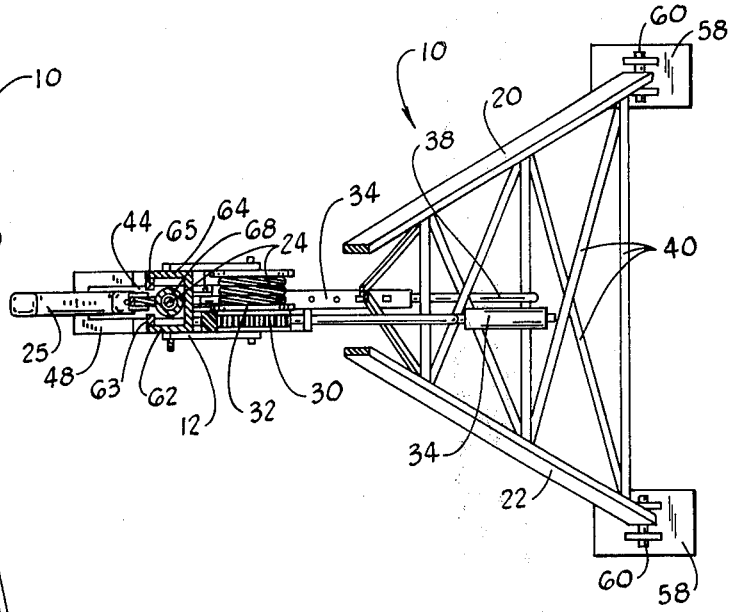
FIG. 5 is a top view of the vehicle bumper jack taken at section 5—5, shown in FIG. 1.

FIG. 5 is a top view of the jack 10 taken in cross section along lines 5—5 in FIG. 1. This cross section shows the channeled structure of the vertical leg 18 with sides 62 and 64. Also, seen more clearly is the top of the adjustable hook 34 with hook portion 38 secured to bracing 40.

In operation, when the jack 10 is removed from storage the angled legs 20 and 22 are rotated outward until the adjustable hook 34 is attached to the bracing 40. By having the adjustable hook 34, the angled legs 20 and 22 can be angled at various degrees from the vertical leg 18 depending on the closeness of the working area and the weight of the vehicle to be lifted.

The vertical leg 18 is placed next to the vehicle's bumper and facing the bumper. The bumper hook 25 is raised or lowered until it is in position to be secured to the bottom of the vehicle's bumper. If the vehicle is parked on a highway that is inclined, the rotatable base plates 44, 56 and 58 will conform to the inclined highway surface while the leg 18 can be maintained substantially in a vertical position for ease in raising and lowering the vehicle.

Should additional cable 24 between the cable lock 68 and bumper hook 25 be required to attach the vehicle's bumper, the setscrew 70 can be loosened and additional cable 24 played out through the cable lock 68.

The removable handle 34 is attached to the worm gear driven windlass 26 and by turning the handle 34 the cable 24 is wound around the drum 14 and the vehicle is easily and safely raised. When the vehicle is lowered, the hook 25 is removed from the vehicle's bumper and the jack 10 can be folded together and stored until later use.

Changes may be made in combination and arrangements of the elements as heretofore set forth in the specifications and shown in the drawings. It is understood that the changes may be made in the embodiments disclosed without deparing from the spirit or scope of the invention as defined in the following claims.

I claim:

1. A foldable self-leveling tripod shaped vehicle bumper jack comprising:

a. a housing having a pulley mounted inside the center portion thereof, a handle attached to the upper portion of said housing;

b. a channeled vertical leg having a rotatable base plate attached to one end of said vertical leg, said plate rotatable in a plane perpendicular to the plane of the vehicle's bumper, said channeled vertical leg partially closed forming a slot along the length thereof;

c. first and second angled legs having rotatable base plates attached to one end of said angled legs, the other end of said angled legs attached to said housing; said plates rotatable in a plane perpendicular to the plane of the vehicle's bumper, said angled legs rigidly secured together by bracing attached to the sides thereof;

d. a cable riding inside said channeled vertical leg, said cable having a bumper hook attached to one end of said cable for securing to the vehicle's bumper;

e. a worm gear driven windlass attached to said vertical leg for winding the other end of said cable thereon, said windlass turned by a removable crank, said windlass receiving said cable as it is wound around said pulley;

f. a hook, the end of said hook attached to said vertical leg, the hook portion of said hook secured to said bracing so that said angled legs are held in place as the vehicle is raised and lowered; and g. a cable lock secured to the cable and riding in said channeled vertical leg, the width of said slot greater than the width of said cable and less than the width of said cable lock.

2. A tripod shaped vehicle bumper jack comprising:

a. a housing;

b. a channeled vertical leg having a rotatably attached base plate, said base plate attached to one end of said vertical leg, the other end of said vertical leg attached to said housing, a front portion of said channeled vertical leg partially closed forming a slot therein;

c. first and second angled legs having rotatably attached base plates, said base plates attached to one end of said angled legs, the other ends of said angled legs attached to said housing, said angled legs rigidly secured together by bracing attached to the sides thereof;

d. a cable riding inside the slot of said vertical leg, one end of said cable extending outwardly through the slot and attached to a bumper hook for securing to the vehicle's bumper;

e. a cable lock secured to said cable, said cable lock having a width greater than said slot, said cable lock riding in said channeled vertical leg and retaining the portion of said cable above said cable lock within said channeled vertical leg; and f. a worm gear driven windless for winding said cable thereon, a removable crank for turning said windless, and a pulley attached to said housing for guiding said cable from said channeled vertical leg to said windless.

3. The jack as described in claim 2 further including a hook, the end of said hook attached to said vertical leg, the hook portion of said hook secured to said bracing so that angled legs are held in place as the vehicle is raised and lowered.

* * * * *